US005845684A

United States Patent [19]

Fletcher, Jr. et al.

[11] Patent Number: 5,845,684

[45] Date of Patent: Dec. 8, 1998

[54] FLUSH AND FILL APPARATUS FOR COOLANT SYSTEMS AND METHOD OF USE

[76] Inventors: Otho N. Fletcher, Jr., 12202 Big Bend Rd., Riverview, Fla. 33569; Timothy D. Fletcher, 2629 Quail Run Blvd., Kissimmee, Fla. 34744

[21] Appl. No.: 773,405

[22] Filed: Dec. 27, 1996

[51] Int. Cl.[6] ..... B65B 1/04; B65B 3/04; B67C 3/02

[52] U.S. Cl. ..... 141/98; 141/5; 141/7; 141/8; 141/59; 141/65; 141/67; 165/95; 134/169 A

[58] Field of Search ..... 141/5, 7, 8, 65, 141/67, 59, 98, 92; 165/95; 184/1.5; 134/169 A, 169 C

[56] References Cited

U.S. PATENT DOCUMENTS 4,276,914 7/1981 Albertson ..... 141/92
5,015,301 5/1991 Baylor et al. ..... 134/169 A
5,318,700 6/1994 Dixon et al. ..... 165/95
5,441,101 8/1995 Johnsson ..... 134/169 A

*Primary Examiner*—Renee S. Luebke
*Assistant Examiner*—Timothy L. Maust
*Attorney, Agent, or Firm*—American Innovations, Inc.

[57] ABSTRACT

A clean and easy-to-use, portable upright apparatus, and a method for its use, which can be used to flush and fill the radiator and coolant systems of motorized vehicles in approximately 15 minutes, the apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

8 Claims, 6 Drawing Sheets

FLUSH AND FILL APPARATUS FOR COOLANT SYSTEMS AND METHOD OF USE

BACKGROUND

1. FIELD OF INVENTION

This invention relates to fluid transfer apparatus, specifically to a clean and easy-to-use apparatus, and a method for its use, which can be used to flush and fill the radiator and coolant systems of motorized vehicles in approximately 15 minutes. In drawing out waste coolant from a coolant system with the help of the vehicle's water pump, the apparatus creates a vacuum that causes new or recycled coolant to enter into the radiator and coolant system of the motorized vehicle. The apparatus comprises a self-priming pump, a waste collection tank, a supply tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

2. DESCRIPTION OF PRIOR ART

For optimum operation of motorized vehicles, it is recommended that the fluid in engine coolant systems be periodically replaced. Although some people discard used coolant, coolants are recyclable and can be prepared for reuse by filtering, refortifying, pH balancing, and undergoing freeze point adjustment. Of particular concern in the discard of used coolants is fact that components of some coolants are toxic to small animals and thereby considered to be environmental pollutants. Since it is becoming increasingly important to minimize discharge of pollutants into the environment, as well as to minimize the waste of all recyclable materials, it would be useful to have a compact, easy-to-use apparatus for the flushing and filling of coolant systems that can also be used to efficiently collect waste coolant for recycling.

It is known to have automatic priming and flushing systems for displacing condensate water from air conditioning systems. U.S. Pat. No. 5,293,894 to Fleischmann (1994) discloses an apparatus comprising a pump assembly, a valve chamber, a reference chamber, a compression spring, a U-shaped siphon housing, and a float for diverting the condensate water into a drain. Also known are fuel transfer apparatus such as that disclosed in U.S. Pat. No. 4,834,132 to Sasaki (1989). The Sasaki invention discloses a system comprising a fuel tank, a feed conduit, a return conduit, two sumps, an ejector pump with a pressure chamber opening into the first sump and in communication to the second sump, the ejector pump also having a fuel nozzle with an inlet port connected to the return conduit and a discharge port connected to the pressure chamber for creating negative pressure within the pressure chamber so that fuel can be sucked from the second sump. Other embodiments of the Sasaki invention can also comprise a relief valve, a diffusing fuel nozzle, and a first sump having a throat with a length to inner diameter ratio of 2:8. Neither the Fleishmann nor the Sasaki inventions provides a compact, portable apparatus having a filter assembly which would be suitable for flushing and filling coolant systems and preserving used coolant for recycling.

Further, apparatus for forcing lubricant from motor vehicle lubricant containing cases is disclosed in U.S. Pat. No. 1,666,992 to Collier (1928). The Collier invention discloses a pressure hose having a nozzle adapted to fit the lubricant filling pipes through a motor crankcases, a lubricant discharge hose which is adapted to connect to the drain opening in a motor crankcase, two tanks, and a standard connected between the hoses and the tanks. Also, oil drain and supply systems are disclosed in U.S. Pat. No. 2,102,795 to Gray (1937) and U.S. Pat. No. 3,867,999 to Cox (1975). The Gray invention comprises a fresh oil reservoir connected to a compressed air source for flow of fresh oil from the reservoir, a waste receiving tank, an upright stem, pipes connecting the upright stem to both the reservoir and the receiving tank, at least one adjustable drain arm connected to the upright stem, and plurality of supply lines also being connected to the upright stem. The Cox invention comprises evacuation and dispensing units which may be separate or combined, pumping means, and an adapter, hose, and self-sealing coupling half for connection to the oil pan drain hole of a vehicle for evacuation of used oil. The present invention has the advantage of being more compactly configured than the Collier, Cox, and Gray inventions, and the present invention comprises a wheeled housing so as to be portable. It is not known in this field to have a compact, clean, and easy-to-use apparatus which can be used to flush and fill the radiator and coolant systems of motorized vehicles in approximately 15 minutes, the apparatus comprising a self-priming pump, a waste collection tank, a supply tank for holding new or recycled coolant, a filter assembly, hoses, and a wheeled support structure which uses a vehicle's water pump to help evacuate waste coolant, and in evacuating waste coolant from the radiator and coolant system of the motorized vehicle creates a vacuum which causes the system to be filled with new or recycled coolant.

SUMMARY OF INVENTION

Objects and Advantages

It is the primary object of this invention to provide a flush and fill apparatus for radiator and coolant systems of motorized vehicles which is easy-to-use and performs the task of flushing and filling radiator and coolant systems with minimal introduction of coolant into the environment. It is also an object of this invention to provide a flush and fill apparatus for radiator and coolant systems of motorized vehicles which uses the water pump of the motorized vehicle to assist in the flush and fill procedure. A further object of this invention is to provide a flush and fill apparatus for radiator and coolant systems of motorized vehicles which in evacuating waste fluid from a coolant system creates a vacuum that quickly draws new or recycled coolant into the coolant system. It is also an object of this invention to provide a flush and fill apparatus for radiator and coolant systems of motorized vehicles which quickly performs the tasks of both flushing and filling radiator and coolant systems. A further object of this invention is to provide a flush and fill apparatus for radiator and coolant systems of motorized vehicles which is compactly housed and portable.

As described herein, properly manufactured and used, the present invention would provide a compactly housed and portable apparatus for easy and quick flushing and filling of radiator and coolant systems of motorized vehicles. The present invention comprises a supply tank for new or recycled coolant, a collection tank for used coolant, a filter assembly through which used coolant must pass prior to its entry into the collection tank, a self-priming pump for creating the vacuum necessary for evacuating waste coolant from the radiator and coolant system of a motorized vehicle and for transferring used coolant from the collection tank and into a remote storage container for recycling, and a wheeled housing for conveniently housing all of the aforementioned components together for efficient operation thereof to flush and fill coolant systems. Collected waste coolant can be filtered down to one micron to remove all heavy metals and impurities. Once filtered, antifoaming agents, rust inhibitors, water pump lubricants, dyes, pH adjusting chemicals, and freeze point adjusting chemicals can be added so that the filtered waste coolant can be reused.

The description herein provides preferred embodiments of the present invention but should not be construed as limiting the scope of the flush and fill invention. For example, variations in the size of pump used, the size and configuration of supply tank used, the material from which the supply tank is made, the positioning of the openings for connection of hoses through the housing, the positioning of the filter assembly within the housing, the dimension of the top shelf, middle shelf, and base member, the size of the wheel assemblies used, the type of material used to construct the housing, the type of fasteners used to secure the pump and filter assembly to the housing, and the type of on-off switch used for remote power access, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 2:
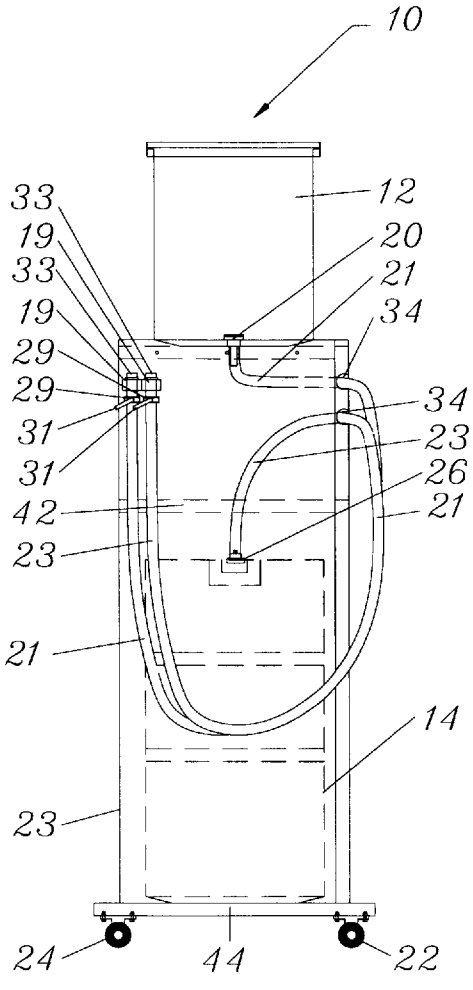
FIG. 2 is a right side view of the invention.
Figure 1:
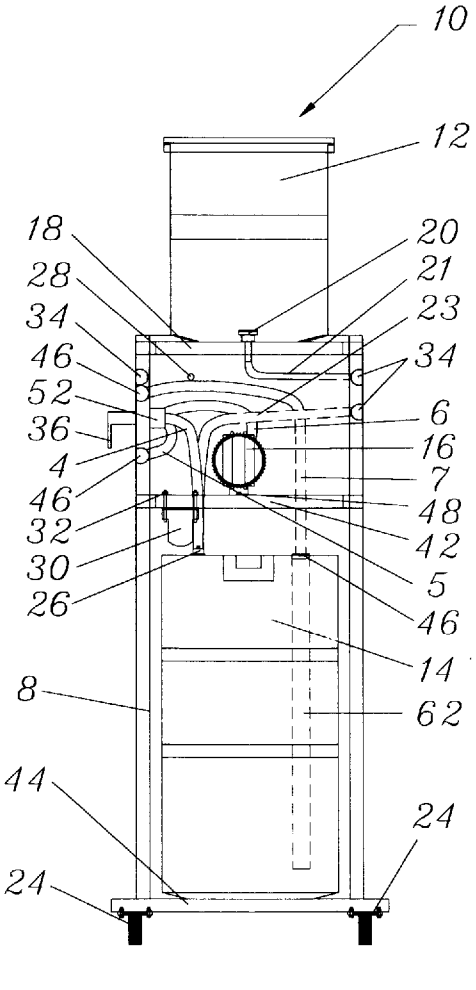
FIG. 1 is a back view of the invention.

FIG. 1 shows a preferred embodiment of a flush and fill system 10 having an upright housing 8 with a top shelf 18, a middle shelf 42, and a base member 44. Movable wheel assemblies 24 are shown laterally connected to the bottom surface of base member 44. FIG. 1 also shows a new or recycled coolant supply tank 12 positioned on the upper surface of top shelf 18 for housing new or recycled coolant. Although the size and configuration of supply tank 12 is not critical to the present invention, in the preferred embodiment it is contemplated for supply tank 12 to have sufficient capacity to contain coolant adequate to completely flush and fill the coolant system of one motorized vehicle. In addition, FIG. 1 shows a waste coolant collection tank 14 positioned on the upper surface of base member 44 and a pump 16 positioned on the upper surface of middle shelf 42 to help evacuate used coolant from a radiator and radiator overfill reservoir, shown respectively as numbers 54 and 56 in FIG. 8., as well as transfer used coolant from collection tank 14 to a remote storage container for recycling, such as storage container 64 shown in FIG. 10. Although neither the size, nor the type, of pump 16 used is critical to the present invention, in the preferred embodiment it is contemplated for pump 16 to be a self-priming diaphragm pump that has sufficient pumping capacity to allow the flushing and filling of the coolant system of a typical motorized vehicle to be accomplished in approximately fifteen minutes. In addition, FIG. 1 shows supply tank 12 having a hose connector 20 centrally connected through the bottom surface of supply tank 12 and positioned through a hose connector opening in top shelf 18, the hose connector opening being shown as number 58 in FIG. 5. FIG. 1 further shows several openings 34 through the upper side portions of upright housing 8, and a supply hose 21 connected between hose connector 20 and the uppermost opening 34 on the right side of housing 8. FIG. 2 shows supply hose 21 extending through upper opening 34 and connected to the outer surface of housing 8 with a hose support bracket 19. Although not shown, it is contemplated for each opening 34 to have a rubber grommet positioned therein for protecting from excessive wear from the outer surfaces of any hoses inserted therethrough. A male quick disconnect 46 and a female quick disconnect 47 are shown connected through the left side of housing 8 with male quick disconnect 46 being positioned above female quick disconnect 47. FIG. 1 also shows a suction hose 23 connected between a two-hose connector assembly 26 positioned through the top of collection tank 14 and the lower opening 34 on the right side of housing 8, as well as a discharge hose 7 connected between male quick disconnect 46 on the left side of housing 8 and a second step down adapter 20 connected through the upper surface of collection tank 14. FIG. 2 shows suction hose 23 extending through lower opening 34 and connected to the outer surface of housing 8 with a hose support bracket 19. Although not shown, it is contemplated for hose clamps to be used in securing the connection between all hoses and the hose adapters 20 to which they are connected. FIG. 1 also shows a filter assembly 30 connected to the bottom surface of middle shelf 42, filter assembly fasteners 32 connected through middle shelf 42 to hold filter assembly 30 in place, a fastener 48 for securing pump 16 to the upper surface of middle shelf 42, and a suction tube 62 within collection tank 14 for facilitating discharge of used coolant from collection tank 14. The type of fasteners used for filter assembly fasteners 32 and fasteners 48 is not critical to the present invention as long as they are of adequate size to securely hold filter assembly 30 and pump 16, respectively, in place during the flush and fill procedure. FIG. 1 further shows a three-way ball valve 52 positioned adjacent to the inside surface of housing 8 between top shelf 18 and middle shelf 42, a rotatable valve lever 36 positioned on the outside surface of housing 8 and connected through housing 8 to ball valve 52 for redirecting fluid flow through ball valve 52, a pump hose 6 connected between ball valve 52 and pump 16, a collection tank hose 4 connected between ball valve 52 and two-hose connector assembly 26, and an evacuation hose 5 connected between ball valve 52 and the female quick disconnect 47 on housing 8.

FIG. 2 shows flush and fill system 10 having upright housing 8 with supply tank 12 positioned on top of housing 8, collection tank 14 positioned between middle shelf 42 and base member 44, with movable wheel assembly 24 attached to the rearward bottom surface of base member 44 and a fixed wheel assembly 22 connected to the forward bottom surface of base member 44. The number of movable wheel assemblies 24 and the number of fixed wheel assemblies 22 is not critical to the present invention. FIG. 2 further shows supply tank 12 having supply hose connector 20 connected through its bottom surface and two openings 34 through the side of upright housing 8. In addition, FIG. 2 shows two hose support brackets 19 positioned on the outside surface of housing 8 with supply hose 21 connected on one of its ends to hose connector 20 and the distal end of supply hose 21 being supported by one hose support bracket 19. FIG. 2 also shows suction hose 23 connected on one of its ends to two-hose connector assembly 26, with the distal end of suction hose 23 being supported by the other hose support bracket 19. FIG. 2 also shows supply hose 21 having a single fluid valve 29 connected to its distal end, a lever 31 connected to fluid valve 29, and a male step down hose adapter 33 having a quick disconnect positioned within its distal end for connection to different sizes of hoses on different makes and models of motorized vehicles. In addition, FIG. 2 also shows suction hose 23 having a single fluid valve 29 connected to its distal end, a lever 31 connected to fluid valve 29, and a step down hose adapter 33 having a quick disconnect positioned within its distal end also for connection to different sizes of hoses on different makes and models of motorized vehicles. In the preferred embodiment it is contemplated for the present invention to comprise a plurality of interchangeable sizes of male step down hose adapters 33 and female hose connectors 20 for connection to a wide variety of makes and models of motorized vehicles, each approximately three inches in length and having the configuration to provide a step down dimension of either one inch, one-and one fourth inches, one-and-one-half inches, one-and-three-fourths inches, or two inches.

Figure 3:
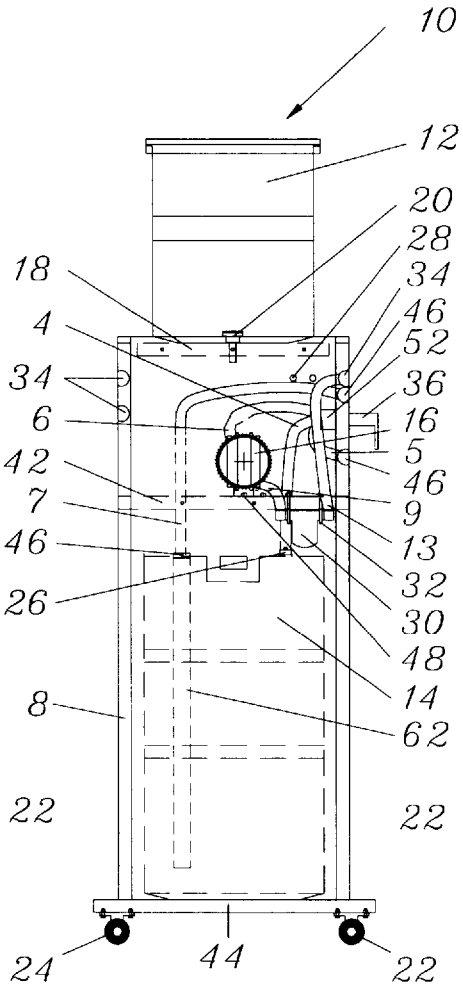
FIG. 3 is a sectional front view of the invention.
Figure 4B:
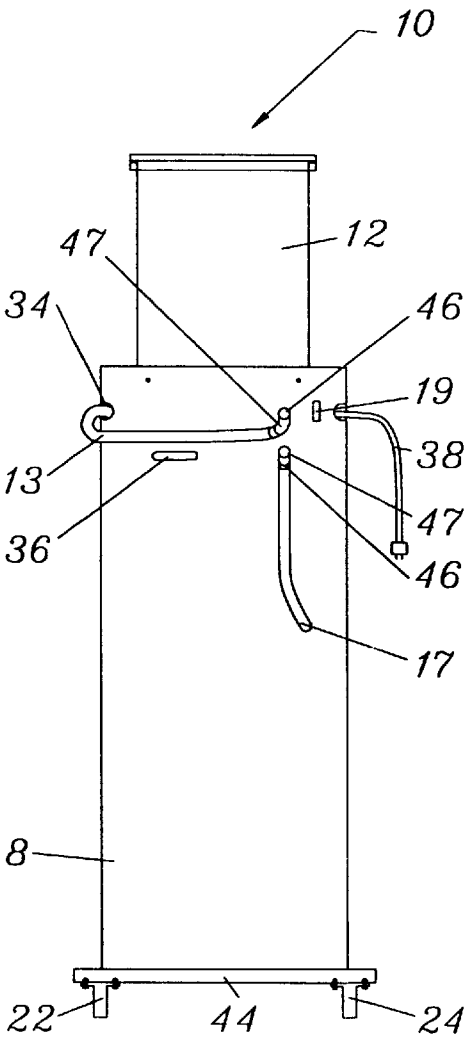
FIG. 4*b* is a left side view of the invention in a mode for evacuation of used coolant from the collection tank.
Figure 4A:
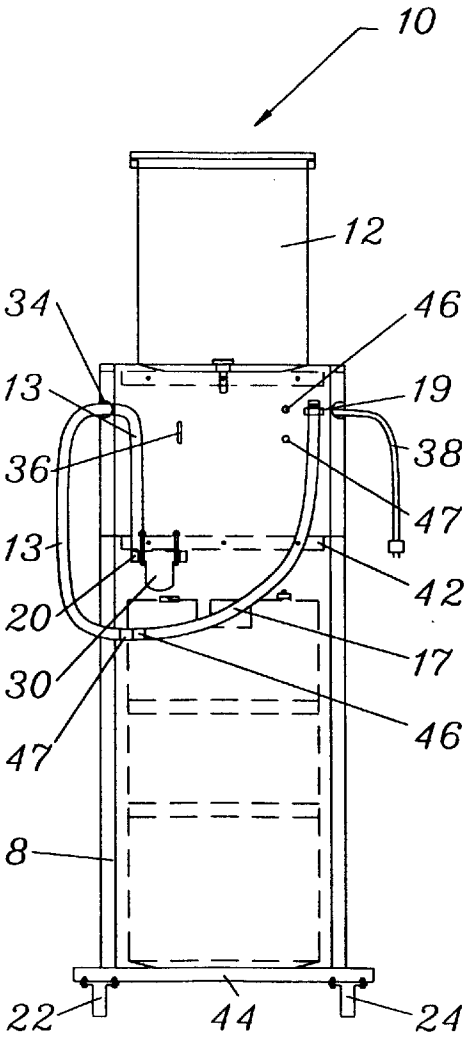
FIG. 4*a* is a left side view of the invention in its flush and fill operational mode.

FIG. 3 shows flush and fill system 10 having upright housing 8 with supply tank 12 positioned on top shelf 18, pump 16 positioned on middle shelf 42, and collection tank 14 positioned on base member 44. Fixed wheel assemblies 22 are shown laterally connected to the bottom surface of base member 44. In addition, FIG. 3 shows supply tank 12 having supply hose connector 20 connected through its bottom surface, openings 34 through the sides of upright housing 8, male quick disconnect 46 and female quick disconnect 47 connected through the right side of housing 8 with male quick disconnect 46 being positioned above female quick disconnect 47, filter assembly 30 connected to the bottom surface of middle shelf 42, filter assembly fasteners 32 holding filter assembly 30 to middle shelf 42, fasteners 48 for securing pump 16 to middle shelf 42, holes 36 for connection of middle shelf 42 and top shelf 18 to upright housing 8, two-hose connector assembly 26 attached through the upper surface of collection tank 14, and a suction tube 62 within collection tank 14 for facilitating removal of used coolant from collection tank 14. In addition, FIG. 3 shows discharge hose 7 connected between male quick disconnect 46 positioned through the right side of housing 8 and step down adapter 20 through the upper surface of collection tank 14, and vacuum hose 13 connected between opening 34 and filter assembly 30. FIG. 4*a* shows vacuum hose 13 extending through opening 34 and connected to the outer surface of housing 8 with a hose support bracket 19. FIG. 3 also shows three-way ball valve 52 positioned adjacent to the inside surface of housing 8 between top shelf 18 and middle shelf 42, rotatable valve lever 36 positioned on the outside surface of housing 8 and connected through housing 8 to ball valve 52 for redirecting fluid flow through ball valve 52, pump hose 6 connected between ball valve 52 and pump 16, collection tank hose 4 connected between ball valve 52 and two-hose connector assembly 26, evacuation hose 5 connected between ball valve 52 and the female quick disconnect 47 on housing 8, and a pump-filter assembly hose 9 connected between pump 16 and filter assembly 30. FIG. 3 also shows an on-off switch 28 positioned through the upper surface of housing 8. The type and configuration of switch used for on-off switch 28 is not critical to the present invention.

FIG. 4*a* shows vacuum hose 13 connected on one of its ends to vacuum hose extension 17 and connected on the other of its ends to filter assembly 30, with supply tank 12 positioned on top of housing 8, base member 44 positioned beneath housing 8, with movable wheel assembly 24 attached to the rearward bottom surface of base member 44 and fixed wheel assembly 22 connected to the forward bottom surface of base member 44. FIG. 4*a* shows vacuum hose 13 inserted through opening 34 and connected through middle shelf 42 on its inside end to filter assembly 30. The other end of vacuum hose 13 is fitted with a female quick disconnect 47 for connection to a male quick disconnect 46, such as the one attached to one end of vacuum hose extension 17, the other end of vacuum hose extension 17 being supported against the outer surface of housing 8 by hose support bracket 19. FIG. 4*a* also shows a power supply cord 38 and plug for connection of pump 16 to a remote 110-volt power source (not shown). In addition, FIG. 4*a* shows a male quick disconnect 46 and a female quick disconnect 47 connected to housing 8, with male quick disconnect 46 positioned above female quick disconnect 47, and valve lever 36 positioned against the outside surface of housing 8 with its distal end at a six-o'clock position. In the configuration shown in FIG. 4*a*, the present invention is ready for flushing and filling a coolant system of a motorized vehicle (not shown). In contrast, FIG. 4*b* shows the present invention ready for evacuating used coolant from collection tank 14 into a remote container, such as storage container 64 shown in FIG. 10. FIG. 4*b* also shows vacuum hose 13 connected through opening 34 and female quick disconnect 47 on its distal end connected to the male quick disconnect 46 located through housing 8 adjacent to hose support bracket 19. FIG. 4*b* also shows valve lever 36 positioned through housing 8 with its distal end in a three-o'clock position, hose support bracket 19 positioned empty against housing 8, electrical cord and plug 38 connected through housing 8, and the male quick disconnect 46 attached to the distal end of vacuum hose extension 17 connected to the female quick disconnect 47 on housing 8.

Figure 5:
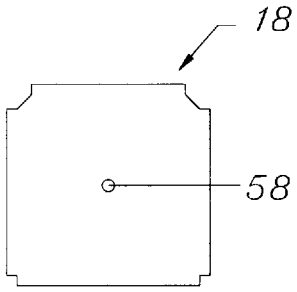
FIG. 5 is a top view of the top shelf of the invention.
Figure 6:
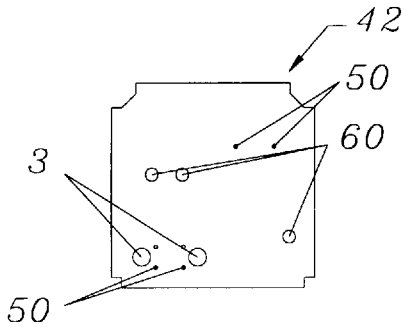
FIG. 6 is a top view of the middle shelf of the invention.
Figure 7:
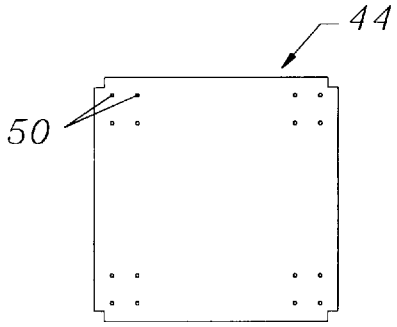
FIG. 7 is a top view of the wheeled base of the invention.

FIGS. 5, 6, and 7 show top shelf 18, middle shelf 42, and base member 44, respectively. FIG. 5 shows top shelf 18 having a hose connector opening 58 for securing supply tank 12 to the upper surface of top shelf 18. FIG. 5 also shows top shelf 18 having corners with cutout portions for secure positioning of top shelf 18 within housing 8. FIG. 6 shows middle shelf 42 having six fastener openings 50 therethrough, the two rearwardmost fastener openings 50 being for attachment of pump 16 with fasteners 48 and the four forwardmost fastener openings 50 being for attachment of filter assembly 30 to middle shelf 42 with filter assembly fasteners 32. FIG. 6 also shows middle shelf 42 having three hose openings 60, the leftmost hose opening 60 being for insertion therethrough of collection tank hose 4, the middle hose opening 60 being for insertion therethrough of suction hose 23, and the rightmost hose opening 60 being for insertion therethrough of vacuum hose 13. Further, FIG. 6 shows middle shelf 42 having two hose connector openings 3 therethrough, a hose connector 20 being positioned through each hose connector opening 3, the left hose connector opening 3 for the connection of filter assembly hose 11 between filter assembly 30 and the male quick disconnect 46 through the left side of housing 8, the right connector opening 3 for the connection of pump-filter assembly hose 9 between filter assembly 30 and pump 16. The comers of middle top shelf 42 also have cutout portions for secure positioning of middle shelf 42 within housing 8. FIG. 7 shows base member 44 having four fastener openings 50 adjacent to each of its corners for the connection thereto of fixed wheel assemblies 22 and movable wheel assemblies 24. The comers of base member 44 also have cutout portions therethrough for secure positioning of base member 44 against the bottom of housing 8. Although top shelf 18, middle shelf 42, and base member 44 are shown to have square configurations, the dimensions of top shelf 18, middle shelf 42, and base member 44 are not critical to the present invention as long as they fit within housing 8 and adequately perform their support functions.

Figure 8:
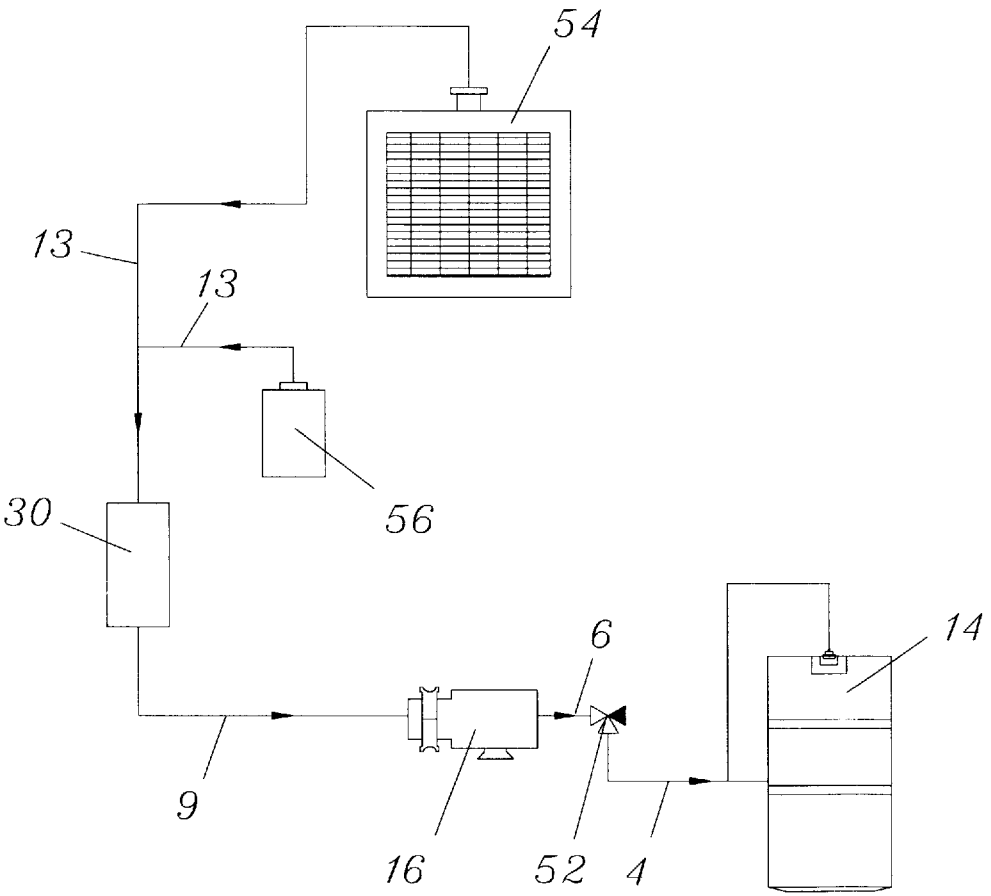
FIG. 8 is a schematic diagram of the suction step in which the invention apparatus is used to remove waste coolant from the radiator and overflow reservoir of the motorized vehicle.

FIG. 8 shows the suction step performed by the present invention to remove most of the used coolant (not shown) from a vehicle's radiator 54 and radiator overfill reservoir 56. FIG. 8 shows filter assembly 30 alternatively connected to motorized vehicle radiator 54 and radiator overfill reservoir 56 via vacuum hose 13, pump-filter assembly hose 9 connected between filter assembly 30 and pump 16, pump hose 6 connected between pump 16 and ball valve 52, and collection tank hose 4 depositing used coolant (not shown) into collection tank 14.

Figure 9B:
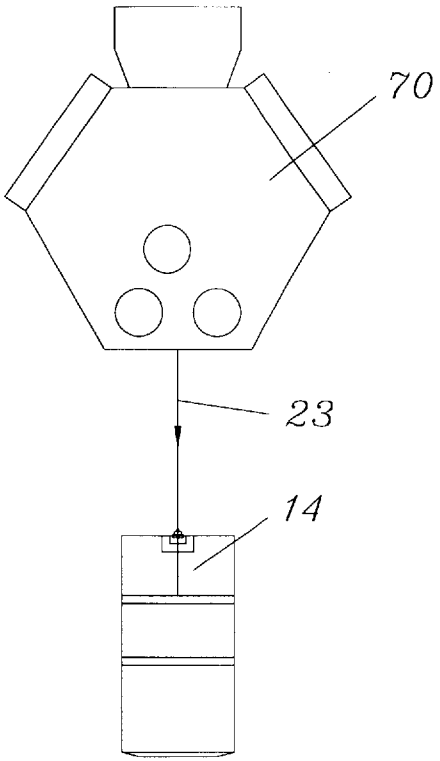
FIG. 9*b* is a schematic diagram of the flush step of the flush and fill procedure using the invention apparatus wherein a vacuum is formed within the coolant system which causes new or recycled coolant to be drawn therein from the supply tank.
Figure 9A:
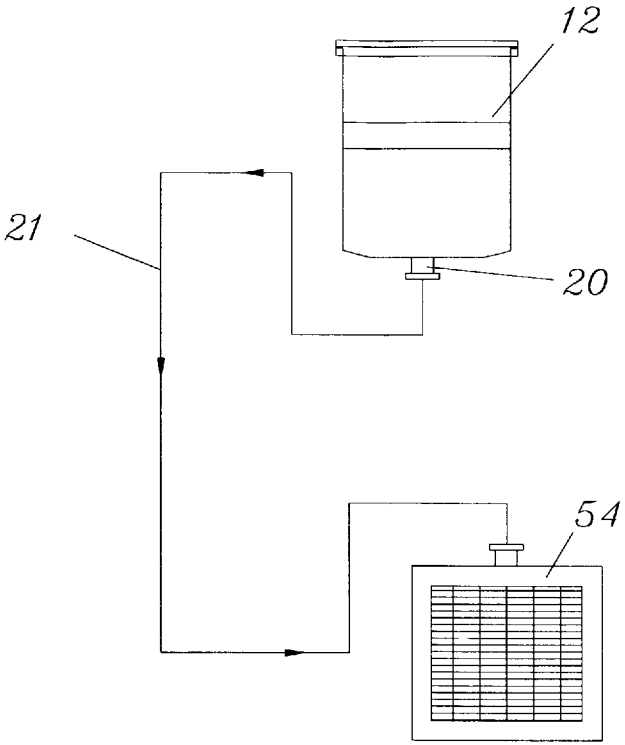
FIG. 9*a* is a schematic diagram of the fill step of the flush and fill procedure using the invention apparatus wherein the water pump of the motorized vehicle is used to create a vacuum within the coolant system which causes new or recycled coolant to be drawn therein from the supply tank.

FIG. 9*a* shows the fill step of the flush and fill procedure performed using the present invention, with supply tank 12 being connected to radiator 54 by supply hose 21. FIG. 9*b* shows the flush step of the flush and fill procedure performed using the present invention, with motorized vehicle engine 70 being connected to collection tank 14 by suction hose 23. During the flush and fill procedure it is contemplated for motorized vehicle engine 70 to be running so that the water pump of the motorized vehicle (not shown) will help to evacuate used coolant from radiator 54 and create a vacuum to draw new or recycled coolant into the motorized vehicle's coolant system.

Figure 10:
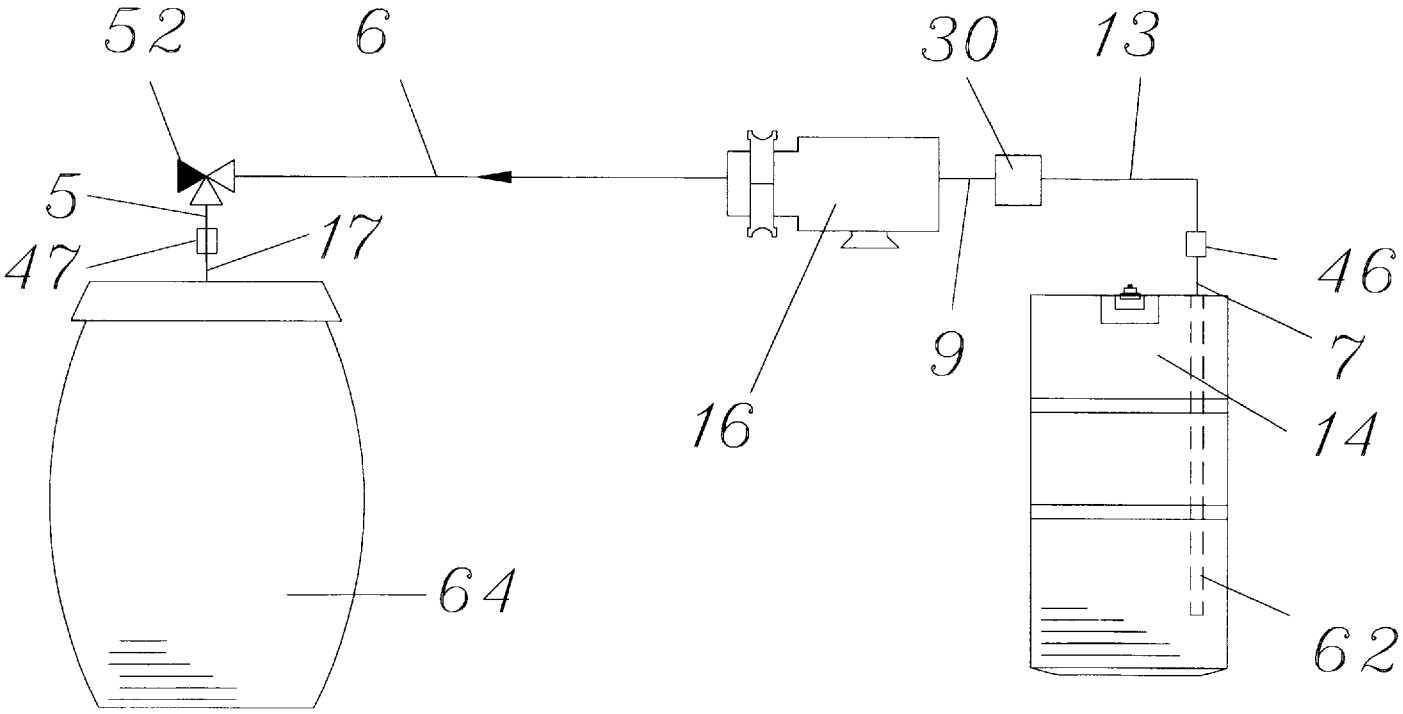
FIG. 10 is a schematic diagram of the waste discharge step wherein waste coolant in the collection tank of the invention apparatus is transferred to a storage container where it can be reconditioned for reuse.

FIG. 10 shows waste discharge step performed using the present invention wherein used coolant (not shown) is quickly and cleanly transferred from collection tank 14 into a storage container 64. FIG. 10 shows suction tube 62 in collection tank 14 being connected to one end of discharge hose 7, the other end of discharge hose 7 being connected to the male quick disconnect 46 on housing 8, the female quick disconnect 47 on the end of vacuum hose 13 being connected to the male quick disconnect 46 on housing 8, the other end of vacuum hose 13 in communication with filter assembly 30, pump-filter assembly hose 9 connected between filter assembly 30 and pump 16, pump hose 6 connected between pump 16 and ball valve 52, evacuation hose 5 connected between ball valve 52 and the female quick disconnect 47 on housing 8, and the male quick disconnect 46 on vacuum hose extension 17 being connected to the female quick disconnect 47 on housing with the other end of vacuum hose extension 17 being in communication with storage container 64 so that when pump 16 is activated, used coolant is transferred to storage container 64 for reconditioning and reuse.

In the preferred embodiment it is contemplated for ball valve 52 to be made from brass and have an inside diameter of approximately one-half of an inch, electrical cord and plug 38 to be approximately six feet in length, for supply hose 21 to have an inside diameter of approximately five-eighths of an inch and be approximately eight feet in length, and for suction hose 23 to have an inside diameter of approximately five-eighths of an inch and be approximately nine feet in length. In the preferred embodiment it is also contemplated for base member 44 to be approximately twenty-two inches square, and for top shelf 18 to be approximately eighteen inches square, for middle shelf 42 to be approximately eighteen inches square. Also in the preferred embodiment it is contemplated for supply tank 12, collection tank 14, and storage container 64 to be made from materials which are inert when in contact with coolants, and for storage container 64 to have a minimum storage capacity of approximately fifty-five gallons. Not critical to the present invention is the placement of openings 34, male quick disconnect 46 on housing 8, female quick disconnect 47 on housing 8, hose support brackets 19, filter assembly 30, pump 16, and ball valve 52, as long as hose connections therebetween are not unduly strained. Also, not critical to the present invention are the size of fixed wheel assemblies 22 and movable wheel assemblies 24, as long as each is sufficiently large Also, the material from which housing 8 is made is not critical to the present invention as long as it is inert to contact with coolant and sufficiently strong to support the weight of housing 8, pump 16, supply tank 12, collection tank 14, and the new and used coolants (not shown) respectively contained therein.

To use the present invention, an operator would determine the volume of coolant (not shown) required by radiator 54, then fill supply tank 12 with sufficient new or recycled coolant to refill radiator 54 and radiator overfill reservoir 56. The operator would also check collection tank 14 to ensure adequate capacity remained therein to accommodate the amount of used coolant to be emptied from radiator 54 and radiator overfill reservoir 56, and then empty collection tank 14 if necessary to make room for the addition of the used coolant (not shown) when vacuumed from radiator 54 and radiator overfill reservoir 56. Thereafter, the operator of the present invention would place on-off switch 28 into its off position and plug electrical cord and plug 38 into a 110-volt power source (not shown) to provide power for pump 16.

When it is determined by the operator that radiator 54 has no built-up pressure therein, he or she would remove the caps on radiator 54 and radiator overfill reservoir 56. Turning the distal end of valve lever 36 into its "vacuum" position by placing it in a six-o'clock position, and with vacuum hose extension 17 being connected to vacuum hose 13, after inserting the distal end of vacuum hose extension 17 into radiator overfill reservoir 56, the operator can turn on pump 16 to remove all of waste coolant (not shown) therein. The operator would then insert vacuum hose 17 into the top of radiator 54 and turn on pump 16 to remove all of the waste coolant possible from radiator 54. When the vacuuming steps are complete, the operator would replace and tighten the caps on both radiator 54 and radiator overfill reservoir 56.

Although the motorized vehicle components mentioned herein are not shown, with the exception of radiator 54 and radiator overfill reservoir 56, the operator would then loosen the upper radiator hose clamp from the motorized vehicle's upper radiator hose, and remove the upper radiator hose from its connection with the upper fitting on radiator 54. After selecting and inserting a correctly sized male step down hose adapter 33 with a quick disconnect between the upper radiator hose and suction hose 23, also selecting and inserting a correctly sized female hose connector 20 with a quick disconnect between supply hose 21 and the upper fitting on radiator 54, and securely attaching both step down hose adapters in place, the operator would make certain that fluid valves 29 are in their closed positions and that suction hose 23 and supply hose 21 are positioned away from moving engine parts. Thereafter, the operator would open the fluid valve 29 attached to supply hose 21. After starting both the motorized vehicle's engine and its heater, the operator would open the fluid valve 29 on suction hose 23 to allow the vehicle's water pump to remove used coolant from radiator 54 while the vacuum created thereby draws new or recycled coolant into radiator 54 through supply hose 21. When the flush and fill process is complete, or when only 2–3 quarts of new or recycled coolant remain in supply tank 12, the fluid valve 29 on the supply hose 21 would be closed. Thereafter, the vehicle's engine and heater would be turned off and the fluid valve 29 on suction hose 23 would be closed. Male step down hose adapter 33 and female hose connector 20 would then be removed, with the upper radiator hose (not shown) being reconnected to the upper fitting on radiator 54 and clamped securely thereto. The operator would then remove the cap on radiator 54, restart the motorized vehicle's engine, and while the engine is running, use supply hose 21 to add new or recycled coolant to radiator 54 to top off both radiator 54 and radiator overfill reservoir 56 with coolant. After continuing to run the engine for a short period of time to ensure that coolant levels are correct, the operator would replace and tighten all caps and check for leaks.

To empty collection tank 14 either before or after flushing and filling the coolant system in a motorized vehicle, the operator would separate the female quick disconnect 47 on the end of vacuum hose 13 from the male quick disconnect 46 on vacuum hose extension 17. He or she would then attach the female quick disconnect 47 on vacuum hose 13 to the male quick disconnect 46 on housing 8. Thereafter, the operator would attach the male quick disconnect 46 on the end of vacuum hose extension 17 to the female quick disconnect 47 on housing 8. Then after turning the distal end of valve lever 36 into its waste discharge position, by placing it in a three-o'clock position, pump 16 would be engaged to transfer used coolant (not shown) into storage container 64. Thereafter, the operator would turn pump 16 off, remove the end of vacuum hose extension 17 from storage container 64, reconnect vacuum hose 13 to vacuum hose extension 17, and return valve lever 36 into its six-o'clock vacuuming position to again ready the present invention for flushing and filling the coolant systems of additional motorized vehicles.

What is claimed is:

1. A system for flushing and filling radiators and coolant systems in motorized vehicles, said system comprising a housing having an outer surface, a plurality of openings through said outer surface, a plurality of wheel assemblies connected to said housing so as to make said housing easily movable, a coolant supply tank positioned upon said housing, said supply tank having a hollow interior, a used coolant collection tank positioned within said housing, said collection tank having an upper surface and an interior chamber, a pump positioned within said housing, a filter assembly also positioned within said housing, a three-way ball valve positioned within said housing, a valve lever connected through said housing to said ball valve, said valve lever being movable between a first position and a second position, a plurality of hose connection means attached to said outer surface of said housing, a two-hose connector assembly communicating with said interior chamber of said collection tank, a supply hose having opposite ends and one of said opposite ends attached to said supply tank so that said supply hose communicates with said hollow interior, a suction hose having opposed ends, the first of said opposed ends communicating with said interior chamber of said collection tank, the second of said opposed ends of said suction hose extending through one of said openings in said housing, a pump hose connected between said ball valve and said pump, a collection tank hose connected between said collection tank and said ball valve, an evacuation hose connected between said ball valve and one of said hose connections on said housing, a pump-filter assembly hose connected between said pump and said filter assembly, a vacuum hose having a first end and a second end, said first end connected to said filter assembly and said second end extending through a second of said openings in said housing, a vacuum hose extension, an on-off switch connected to said pump, and electrical connection means attached through said housing for connection of said pump to a remote power source so that when said valve lever is placed into said first position said vacuum hose can be used with said pump to evacuate used coolant from the radiator and coolant system of a motorized vehicle, route said used coolant through said filter assembly, and move said used coolant into said collection tank for temporary storage, after which when said suction hose is positioned within said radiator, in conjunction with the water pump of said motorized vehicle will create a vacuum in said coolant system to cause new coolant in said supply tank to be drawn from said supply hose and into said radiator and coolant system, and when said vacuum hose is separated from said vacuum hose extension, said valve lever is placed into said second position, said vacuum hose is connected to one of said hose connection means on said housing for communication with said collection tank, and said vacuum hose extension is also attached to said one of said hose connection means on said housing for communication with said ball valve, said pump is able to cause used coolant in said collection tank to move through said vacuum hose extension and into a remote storage container for recycling.

2. A system for flushing and filling radiators and coolant systems in motorized vehicles, said system comprising an upright housing having an outer surface a plurality of openings therethrough; a plurality of wheel assemblies connected to said housing so as to make said housing easily movable; a new coolant supply tank positioned upon said housing, said supply tank having a hollow interior and a first hose connector inserted therethrough; a used coolant collection tank positioned within said housing, said collection tank having an upper surface and an interior chamber; a pump positioned within said housing; a filter assembly also positioned within said housing; a three-way ball valve positioned within said housing; a valve lever connected through said housing to said ball valve, said valve lever movable between a first position and a second position; a male quick disconnect attached to said outer surface of said housing; a female quick disconnect attached to said outer surface of said housing, said male quick disconnect being positioned above said female quick disconnect; a two-hose connector assembly connected through said upper surface of said collection tank; a supply hose having a first end and a second end, said first end connected to said first hose connector and said second end extending through a first one of said openings in said housing, said second end having a fluid valve attached thereto to selectively prevent fluid flow beyond said second end; a suction hose having opposed ends, the first of said opposed ends communicating with said interior chamber of said collection tank, the second of said opposed ends of said suction hose extending through a second one of said openings in said housing, said second opposed end having a fluid valve attached thereto to selectively prevent fluid flow beyond said second opposed end; a pump hose connected between said ball valve and said pump; a collection tank hose connected between said collection tank and said ball valve; an evacuation hose connected between said ball valve and said female quick disconnect on said housing; a pump-filter assembly hose connected between said pump and said filter assembly; a vacuum hose having opposite ends, the first of said opposite ends connected to said filter assembly and the second of said opposite ends extending through a third opening in said housing, said second opposite end having a female quick disconnect attached thereto, a vacuum hose extension having a male quick disconnect on one of its ends, and off-on switch connected through said housing for engaging and disengaging said pump, and an electrical cord and plug for connection of said pump to a remote power source so that when said valve lever is placed into said first position said vacuum hose can be used with said pump to evacuate used coolant from the radiator and coolant system of a motorized vehicle, route said used coolant through said filter assembly, and move said used coolant into said collection tank, after which said suction hose in conjunction with the water pump of said motorized vehicle creates a vacuum in said coolant system to cause new coolant in said supply tank to be drawn from said supply hose and into said radiator and coolant system, and when said vacuum hose is separated from said vacuum hose extension, said valve lever is placed into said second position, said female quick disconnect on said vacuum hose is connected to said male quick hose connection means on said housing, and said male quick disconnect on said vacuum hose extension is attached to said female quick hose connection means on said housing, said pump will be able to cause used coolant in said collection tank to move through said vacuum hose extension and into a remote storage container for recycling.

3. The system of claim 2 wherein said housing further comprises a top shelf, a middle shelf, and a base member, said top shelf having a hose connector opening therethrough and said first hose connector being positioned through said hose connector opening, said middle shelf having a plurality of hose connector openings, a plurality of hose openings, and a plurality of fastener openings therethrough, said base member having a lower surface with said wheel assemblies connected to said lower surface, said supply tank being positioned upon said top shelf, said pump and said filter assembly being attached to said middle shelf, and said collection tank being positioned upon said base member.

4. The system of claim 3 wherein said wheel assemblies comprise a plurality of fixed wheel assemblies and a plurality of movable wheel assemblies.

5. The system of claim 4 further comprising a plurality of hose support brackets connected to said outer surface of said housing.

6. The system of claim 5 comprising three of said hose support brackets, one each for supporting said supply hose, said suction hose, and said vacuum hose extension.

7. The system of claim 6 further comprising a plurality of male step down hose adapters for connecting said supply hose to the cooling systems of a variety of makes and models of motorized vehicles and a plurality of female hose connectors for connecting said suction hose to the cooling systems of a variety of makes and models of motorized vehicles.

8. A method for flushing and filling a radiator and coolant system in a motorized vehicle, said method comprising the steps of providing a motorized vehicle with a radiator and coolant system and having used coolant therein, new coolant, a portable upright housing, a coolant supply tank, a collection tank, a storage tank, a supply hose, a suction hose, a three-way ball valve, a pump hose, an evacuation hose, a pump-filter assembly hose, a collection tank hose, a rotatable valve lever, a vacuum hose with a female quick disconnect on one of its ends, a vacuum hose extension with a male quick disconnect on one of its ends, a filter assembly, a pump, a plurality of male step down hose adapters, a plurality of female hose connectors, an on-off switch, and electrical connection means; determining the approximate volume of used coolant in said radiator and coolant system; filling said supply tank with an amount of said new coolant sufficient to refill said radiator and coolant system; checking said collection tank to ensure adequate capacity remains in said collection tank to accommodate said amount of used coolant to be emptied from radiator and coolant system; emptying said collection tank as necessary to make room for said used coolant by placing said on-off switch into its off position, connecting said electrical connection means to a remote power source, separating said female quick disconnect on said distal end of said vacuum hose from said male quick disconnect on said vacuum hose extension, attaching said female quick disconnect on said vacuum hose to said male quick disconnect on said housing, attaching said male quick disconnect on said end of said vacuum hose extension to said female quick disconnect on said housing, rotating said valve lever into a waste discharge position, engaging said pump to transfer said used coolant from said collection tank and into said storage container, turning off said pump, removing said end of said vacuum hose extension from said storage container, reconnecting said vacuum hose to said vacuum hose extension, and returning said valve lever into a flush and fill position; confirming that said on-off switch is in its off position; confirming that said electrical connection means is connected to a remote power source to provide power for said pump; determining that said radiator has no built-up pressure therein; removing the caps of said radiator and the overfill reservoir of said radiator, connecting said male quick disconnect on said vacuum hose extension to said female quick disconnect on said vacuum hose; rotating said valve lever into a position so that said pump will cause said used coolant to be vacuumed through said vacuum hose extension and into said collection tank; inserting the distal end of said vacuum hose extension into said overfill reservoir of said radiator, turning on said pump and thereby causing said pump to remove all of said used coolant from said overfill reservoir of said radiator; inserting said vacuum hose extension into the top of said radiator; turning on said pump to remove all of said used coolant possible from said radiator; when the above vacuuming steps are complete replacing the caps on said radiator and the overfill reservoir of said radiator; tightening the caps on said radiator and the overfill reservoir of said radiator; loosening the upper radiator hose clamp from the upper hose connected to said radiator; removing said upper hose from said radiator; inserting a correctly sized one of said male step down hose adapters with its quick disconnect between the upper hose of said radiator and the distal end of said suction hose; also inserting a correctly sized one of said female hose connectors between said supply tank hose and the upper fitting on said radiator; securely attaching said step down hose adapters and said hose connectors in place; placing fluid valves attached to the distal ends of said suction hose and said supply hose in closed positions; positioning said suction hose and said supply hose away from moving engine parts in said motorized vehicle; opening said fluid valve attached to said supply hose; starting the engine and heater of said motorized vehicle; opening said fluid valve on said suction hose to allow the water pump of said motorized vehicle to remove waste coolant from said radiator and draw new coolant into said radiator from said supply hose; when all of said used coolant is removed from said radiator and coolant system, closing said fluid valve on said supply hose; turning off said engine and said heater of said motorized vehicle; closing said fluid valve on said suction hose; removing said male step down hose adapter and said female hose connector; reconnecting said upper hose on said radiator to said upper radiator hose connection; securely clamping said upper hose in place; removing said cap on said radiator; restarting said engine on said motorized vehicle; while said engine on said motorized vehicle is running using said supply hose to add new coolant to said radiator to top off both said radiator and said overfill reservoir of said radiator; continuing to run said engine until coolant levels are correct; replacing all of said caps; tightening all of said caps; and checking for leaks.

* * * * *